US007691791B2

(12) United States Patent
Usami

(10) Patent No.: US 7,691,791 B2
(45) Date of Patent: Apr. 6, 2010

(54) LUBRICANT MOLDED BODY, LUBRICANT APPLICATION APPARATUS, PROCESS CARTRIDGE, AND IMAGE FORMING APPARATUS

(75) Inventor: Joe Usami, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 309 days.

(21) Appl. No.: 11/603,079

(22) Filed: Nov. 22, 2006

(65) Prior Publication Data

US 2007/0123435 A1 May 31, 2007

(30) Foreign Application Priority Data

Nov. 28, 2005 (JP) ..... 2005-342401

(51) Int. Cl.

| | |
|---|---|
| ***C10M 109/00*** | (2006.01) |
| ***C10M 171/00*** | (2006.01) |
| ***F16C 33/04*** | (2006.01) |
| ***F16C 33/20*** | (2006.01) |
| ***G03G 21/00*** | (2006.01) |

(52) U.S. Cl. ..... 508/107; 508/108; 508/109; 508/106; 524/398; 524/399; 524/400; 523/210; 399/123

(58) Field of Classification Search ..... 508/100–109; 524/45, 349, 398, 399, 400; 523/210; 521/918; 399/123

See application file for complete search history.

(56) References Cited

U.S. PATENT DOCUMENTS 2,529,512 A * 11/1950 Ott ..... 521/128
3,501,294 A 3/1970 John
6,160,142 A * 12/2000 Sawada et al. ..... 554/158
6,554,246 B1 4/2003 Nadakatti et al.
2003/0129511 A1 7/2003 Kabata et al.

FOREIGN PATENT DOCUMENTS

| | | |
|---|---|---|
| JP | 07-026278 | 1/1995 |
| JP | 07-026278 A | 1/1995 |
| JP | 10-008097 A | 1/1998 |
| JP | 10-279998 A | 10/1998 |
| JP | 11-035997 A | 2/1999 |
| JP | 2005-144976 A | 6/2005 |
| WO | WO 97/22684 | 6/1997 |

OTHER PUBLICATIONS

European Patent Office Search Report dated Jan. 24, 2007, for corresponding European Patent Application No. 06024183.
"Database WPI Week 199514," by Derwent Publications Ltd., London, GB, relating to Japanese Patent Publication No. 07-026278.

* cited by examiner

*Primary Examiner*—Glenn A Caldarola
*Assistant Examiner*—Pamela Weiss
(74) *Attorney, Agent, or Firm*—Harness, Dickey & Pierce, P.L.C.

(57) ABSTRACT

A lubricant molded body, which is to be applied to a surface of a photosensitive layer for electrophotography in an image forming apparatus, for example, is composed of at least two kinds of higher fatty acid metallic salts having respectively different carbon numbers. As the higher fatty acid metallic salt that forms lubricant molded body, compounds such as zinc stearate, calcium stearate, barium stearate, aluminum stearate, zinc laurate, calcium laurate, etc. may be recited. The higher fatty acid metallic salts may contain at least one kind of fillers selected from the group consisting of silica, alumina, tungsten disulfide, molybdenum disulfide, graphite fluoride, graphite, boron nitride, polytetrafluoroethylene (PTFE), ethylene tetrafluoroethylene (ETFE), and polyvinylidene fluoride (PVDF).

15 Claims, 5 Drawing Sheets

LUBRICANT MOLDED BODY, LUBRICANT APPLICATION APPARATUS, PROCESS CARTRIDGE, AND IMAGE FORMING APPARATUS

PRIORITY TO BE CLAIMED

The Convention priority of Japanese patent application No. 2005-342401 filed on Nov. 28, 2005 is claimed in this application, and the contents of the above Japanese patent application are incorporated hereinto by reference.

BACKGROUND OF THE INVENTION (1) Field of the Invention

The present invention relates to a lubricant molded body to be applied onto a surface of a photosensitive layer for electrophotograph, a lubricant application apparatus to apply the lubricant of the lubricant molded body to the surface of the photosensitive layer for the electrophotograph, a process cartridge equipped with the lubricant application apparatus, and an image forming apparatus equipped with the lubricant application apparatus.

(2) Related Art Statement

To improve the cleaning power of the electrophotography apparatus used with the copier or the like, a technique is proposed, which applies a higher fatty acid metallic salt (metallic soap) to an image carrier or an intermediate transfer belt as a lubricant or cleaning adjuvant. This higher fatty acid metallic salt chiefly indicates higher fatty acid salts of metals: alkaline earth metals. The higher fatty acid metallic salt has the structure in which a non-polar part based on the higher fatty acid part is combined with a polar part based on the metal portion. The polar parts gather together due to electrostatic force, while the non-polar parts are rubbed together to exhibit high lubricity.

When such a higher fatty acid metallic salt is applied to the image carrier or the intermediate transfer belt, adhesion of the developer to the image carrier or the intermediate transfer belt decreases. In addition, since the higher fatty acid metallic salt agglomerates to the surface of the image carrier or the intermediate transfer belt as nuclei, the cleaning power for the image carrier and the intermediate transcript belt is improved. Furthermore, because the depth of wearing of the image carrier decreases, the use life of the image carrier becomes longer.

As a coating system of the higher fatty acid metallic salt, there is employed a system in which a block-shaped lubricant molded body formed from the higher fatty acid metallic salt is shaved off with a brush or the like, and resulting shaved pieces in the form of fine powder are coated. Such a coating system is advantageous from the viewpoint of saved space, quantitative and uniformity application, and control on the applied amount.

FIG. 4 is a schematic explanation view of a conventional lubricant application apparatus. In FIG. 4, 101 is a lubricant molded body, 102 is a planar support, and 103 is a brush roller. The lubricant molded body 101 has a rectangular parallelepiped block shape with a large aspect ratio. Such a lubricant molded body 101 is fixed on the planar support 102. The surface of the lubricant molded body is shaved off with a brush roller 103 that is rotated on the surface of the molded body, and the finely powdery higher fatty acid metallic salt that is adhered to the brush roller 103 is transferred and uniformly applied onto the image carrier (See "1" in FIG. 3) and the intermediate transfer belt (See "**6*b*" in FIG. 3) arranged at respective positions contacting with the brush roller 103. The lubricant molded body 101 may be directly contacted to the image carrier or the intermediate transfer belt without the brush roller 103** placed, depending upon the construction.

FIG. 5 shows a conventional molding die to form lubricant molded bodies, FIGS. 5(A), 5(B) and 5(C) being a plan view, and a sectional view along a line B-B and a sectional view along a line C-C in FIG. 5(A), respectively. The conventional molding die that forms the lubricant molded bodies has a split mold structure. The molding die consists of three split die portions: a middle die portion 104 being planar, an upper die portion 105 having an arbitrary number of bar-shaped cavities 107 corresponding to molded bodies to be molded, and a lower die portion 106 also having an arbitrary number of bar-shaped cavities 107 corresponding to molded bodies to be molded. The length of the cavity 107 is made longer than that of the desired lubricant molded body.

When such a molding die is to be used, the upper portion 105, the middle die portion 104 and the lower mold die portion 106 are fastened by an arbitrary means and preheated, and then the higher fatty acid metallic salt is melted by heating, and then charged into the cavities 107. The charged salt is spontaneously cooled to solidify the higher fatty acid metallic salt. As the higher fatty acid metallic salt that forms lubricant molded body 101, compounds such as zinc stearate, calcium stearate, barium stearate, aluminum stearate, zinc laurate, calcium laurate, etc. are recited. The lubricant molded body 101 is obtained through heating and melting the higher fatty acid metallic salt in a highly powdery state, pouring the melt in the molding die with the cavities each having a desired shape, and solidifying the thus melted higher fatty acid metallic salt by cooling.

However, the shrinkage of the higher fatty acid metallic salt is large at the time of solidification in cooling. Consequently, particularly when the higher fatty acid metallic salt was molded as a lubricant molded body having a rod-like shape with a large aspect ratio, there was a problem that the molded body was likely to be cracked or cut at the time of solidification in cooling.

In view of this, there is proposed a technique (JP7-26278A now patented under Japanese Patent No. 2,796,486) that cracking and cutting are prevented by solidifying the melted higher fatty acid metallic salt within the molding die by cooling successively from a lower portion to an upper portion. This technique opened a way to enable the mass production of rod-shaped lubricant molded bodies. However, since it is necessary to effect cooling for a long time period so as to avoid rapid shrinkage at the time of solidification in cooling, the number of metal molding dies must be increased to raise the production amount. Therefore, there was a problem that the initial investment cost increased.

Moreover, a technology was proposed, which decreased cracking and cutting of the molded bodies on molding by alleviating the strain due to shrinkage through providing an appropriate space to the metal mold (See JP10-279998A). However, there was also a problem in this technology that it was necessary to monitor the cooling temperature carefully.

SUMMARY OF THE INVENTION

This invention is to solve the above-mentioned problems.

That is, a first object of the present invention is to provide a lubricant molded body, at a low cost, with a fewer cracking and cutting, regardless of the manufacturing method.

It is a second object of the present invention to provide a lubricant application apparatus, at a low cost, which applies a film of a lubricant of the lubricant molded body to a surface of an image carrier for electrophotograph.

A third object of the present invention is to provide an image forming apparatus, at a low cost, which is equipped with the lubricant application apparatus.

A fourth aspect of the present invention is to provide a process cartridge, at a low cost, which is equipped with the lubricant application apparatus.

In order to achieve the above-mentioned objects, the first aspect of the present invention relates to a lubricant molded body which comprises at least two kinds of higher fatty acid metallic salts having different numbers of carbons, respectively.

The following are preferred embodiments (1) to (8) of the first aspect of the present invention. Combinations of (1) to (8) are also preferred embodiments of the present invention, unless any contradiction occurs.

(1) The higher fatty acid metallic salts contain at least one kind of fillers selected from the group consisting of silica, alumina, tungsten disulfide, molybdenum disulfide, graphite fluoride, graphite, boron nitride, polytetrafluoroethylene (PTFE), ethylene tetrafluoroethylene (ETFE), and polyvinylidene fluoride (PVDF).

(2) The higher fatty acid metallic salts comprise at least two kinds of higher fatty acid metallic salts with different metals.

(3) Fine pieces of a foamed resin body are mixed into the higher fatty acid metallic salts. For example, the foamed resin body has the porosity of 70% to 95% with the average cell diameter of 50 μm to 100 μm. The sizes of the cells may range from a few μm to an order of mm, for example. The fine pieces have 0.5 to 10 times those of the cells.

(4) The fine pieces of the foamed resin body are mixed into the lubricant molded body at a rate of 1 to 10% by weight of the entire weight of the lubricant molded body, which is taken as 100% by weight.

(5) The higher fatty acid metal salts are impregnated into a block of the foamed resin body.

(6) The block of the foamed resin body is one kind of block selected from the group consisting of a sheet-shaped block of the foamed resin body, cylindrical block of the foamed resin body and a step-like block of the foamed resin body.

(7) The foamed resin body has an open-cell structure.

(8) Cell diameters of the foamed resin body are 10 μm to 500 μm.

A second aspect of the present invention relates to a lubricant application apparatus comprising a lubricant molded body, and a brush roller which is to contact with both the lubricant molded body and an image carrier and to form a film of a lubricant onto a surface of a photosensitive layer of the image carrier by shaving off the lubricant molded body and supplying the shaved lubricant onto the surface of the photosensitive layer, said lubricant molded body being the lubricant molded body in the first aspect of the present invention.

A third aspect of the present invention relates to a process cartridge comprising an image carrier, a cartridge casing for retaining the image carrier in a freely rotatable manner, and the lubricant application apparatus of the second aspect of the present invention.

The following are preferred embodiments of the third aspect of the present invention.

(1) The process cartridge further comprises a cleaning device, and the lubricant application apparatus provided on an upstream side from the cleaning device in a moving direction of the image carrier.

(2) The cleaning device has a cleaning blade.

A fourth aspect of the present invention relates to an image forming apparatus comprising the process cartridge according to the third aspect of the present invention, a charging device for uniformly charging a surface of the photosensitive layer of the image carrier, an exposing device to expose a surface of the photosensitive layer and to form an electrostatic latent image on the surface of the photosensitive layer, a developing device to visualize the electrostatic latent image on the surface of the photosensitive layer, a transfer device to transfer the toner image on the surface of the photosensitive layer onto a transfer medium, and a cleaning device to clean the surface of the photosensitive layer of the image carrier after the transfer.

The following are preferred embodiments of the fourth aspect of the present invention.

(1) The lubricant application apparatus of the second aspect of the present invention is arranged in a downstream side of the image carrier and on an upper stream side of the cleaning device as viewed from the transcript device.

(2) The cleaning means's has the cleaning blade.

According to the first aspect of the present invention, since the lubricant molded body comprises at least two kinds of higher fatty acid metallic salts having different numbers of carbons, respectively, fine crystallization is promoted based on the difference in crystallization temperature between at least two kinds of the higher fatty acid metallic salts, and the lubricant molded body having far fewer cracking and cutting can be provided at a low cost irrespective of the manufacturing method.

The following are effects obtained by the above (1) to (8) of the first aspect of the present invention, respectively.

(1) Since the higher fatty acid metallic salts contain at least one kind of fillers selected from the group consisting of silica, alumina, tungsten disulfide, molybdenum disulfide, graphite fluoride, graphite, boron nitride, polytetrafluoroethylene (PTFE), ethylene tetrafluoroethylene (ETFE), and polyvinylidene fluoride (PVDF), stress generated due to volume shrinkage when the melted higher fatty acid metallic salts are solidified in cooling can be reduced. Consequently, lubricant molded body that exhibits far smaller cracking or cutting can be produced at a lower cost, irrespective of the production process.

(2) Since the higher fatty acid metallic salts comprise at least two kinds of higher fatty acid metallic salts with different metals, fine crystallization is promoted based on their different crystallization temperatures, so that the lubricant molded body having further reduced cracking and cutting can be provided at lower cost regardless of the manufacturing method.

(3) & (4) Since the fine pieces of the foamed resin are mixed into the lubricant molded body, strain generated when the higher fatty acid metal salts are contained is solidified in cooling can be absorbed, thereby reducing cracking and cutting.

(5) & (6) The higher fatty acid metallic salts are impregnated into the foamed resin block. Thus, since the foamed resin block absorbs strain generated when the melted higher fatty acid metal salts are solidified, cracking and cutting of the lubricant molded body can be reduced. In addition, the lubricant molded body can be manufactured merely by the impregnation of the melted higher fatty acid metallic salt into the foamed resin block.

(7) & (8) Since the foamed resin body has the open-cell structure, a time period required to impregnate the melted higher fatty acid metallic salt into the foamed resin block can be shortened.

In the lubricant application apparatus of the second aspect of the present invention comprising the lubricant molded body, and the brush roller which is to contact with both the lubricant molded body and the image carrier and to form a film of the lubricant onto the surface of a photosensitive layer of the image carrier by shaving off the lubricant molded body and supplying the shaved lubricant onto the surface of the photosensitive layer, since the lubricant molded body is the lubricant molded body of the first aspect of the present invention, the use life of the lubricant application apparatus can be prolonged.

According to the third aspect of the present invention, the process cartridge comprises the image carrier, the cartridge casing retaining the image carrier in a freely rotatable manner, and the lubricant application apparatus of the second aspect of the present invention. Thus, cracking and cutting of the lubricant molded body can be reduced. Then, the use life of the lubricant application apparatus can be extended. Further, since the exchanging work etc. of those parts become easy, the exchange time of such parts can be shortened.

In the process cartridge and the image forming apparatus, when the process cartridge comprises the cleaning device, and the lubricant application apparatus is provided on an upstream side from the cleaning device in a moving direction of the image carrier, a coated film of the lubricant can be formed on the surface of the photosensitive layer of the image carrier by applying the lubricant thereon after the transfer step, and then the lubricant film can be formed through contacting the cleaning device on the surface of the coated film of the lubricant. Consequently, a uniformly cleaned state and a charging hazard are attained. The cleaned state of the surface of the photosensitive layer can be maintained for a longer time. Thus, the image having a higher resolution can be obtained.

In the process cartridge and the image forming apparatus, when the cleaning device has the cleaning blade, a constant quantity of the lubricant can be easily fed over a long time period without addition of any part to rub and smoothen the lubricant flat.

The image forming apparatus according to the fourth aspect of the present invention comprises the process cartridge according to the third aspect of the present invention, the charging device for uniformly charging the surface of the photosensitive layer of the image carrier, the exposing device to expose the surface of the photosensitive layer and to form the electrostatic latent image on the surface of the photosensitive layer, the developing device to visualize the electrostatic latent image on the surface of the photosensitive layer, the transfer device to transfer the toner image on the surface of the photosensitive layer onto the transfer medium, and the cleaning device to clean the surface of the photosensitive layer of the image carrier after the transfer step. Thus, the images having a high quality can be obtained over a long time period without incurring costs.

BRIEF DESCRIPTION OF THE DRAWINGS

For a better understanding of the invention, reference is made to the attached drawings, wherein.

BEST MODE TO CARRY OUT THE INVENTION

Figure 1:
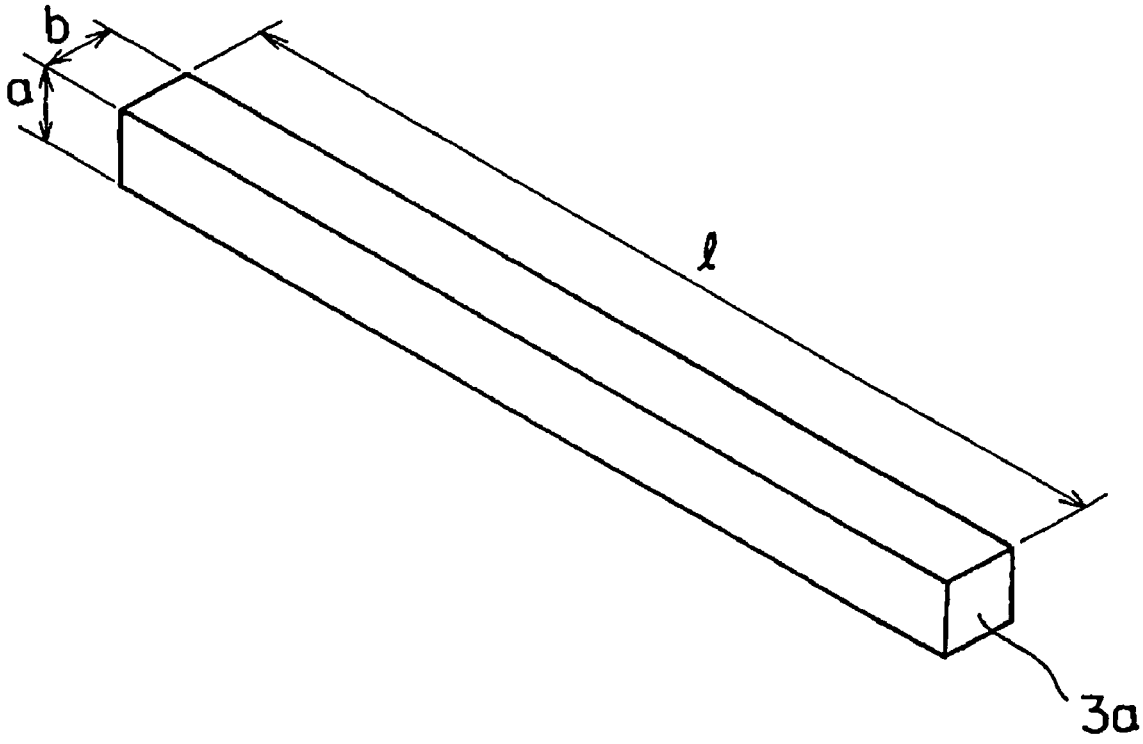
FIG. 1 is a perspective view of a first embodiment of the lubricant molded body of the present invention.

FIG. 1 is a perspective view of a first embodiment of the lubricant molded body of the present invention.

The lubricant molded body 3*a* is composed of at least two kinds of higher fatty acid metallic salts with different numbers of carbons, respectively. When the lubricant molded body comprises at least two kinds of the higher fatty acid metallic salts with the different numbers of carbons, respectively, fine crystallization is promoted based on the difference in crystallization temperature between at least two kinds of the higher fatty acid metallic salts. Consequently, the lubricant molded body 3*a* having far fewer cracking and cutting can be provided at a low cost irrespective of the manufacturing method.

Preferably, the higher fatty acid metallic salts contain at least one kind of fillers selected from the group consisting of silica, alumina, tungsten disulfide, molybdenum disulfide, graphite fluoride, graphite, boron nitride, polytetrafluoroethylene (PTFE), ethylene tetrafluoroethylene (ETFE), and polyvinylidene fluoride (PVDF). When the higher fatty acid metallic salts contain at least one kind of the fillers selected from the group consisting of silica, alumina, tungsten disulfide, molybdenum disulfide, graphite fluoride, graphite, boron nitride, polytetrafluoroethylene (PTFE), ethylene tetrafluoroethylene (ETFE), and polyvinylidene fluoride (PVDF), the stress generated due to the volume shrinkage when the melted higher fatty acid metallic salts are solidified through being cooled can be decreased. Therefore, the lubricant molded body 3*a* with fewer cracking and cutting can be provided, at a low cost, regardless of the manufacturing method.

Figure 5A:
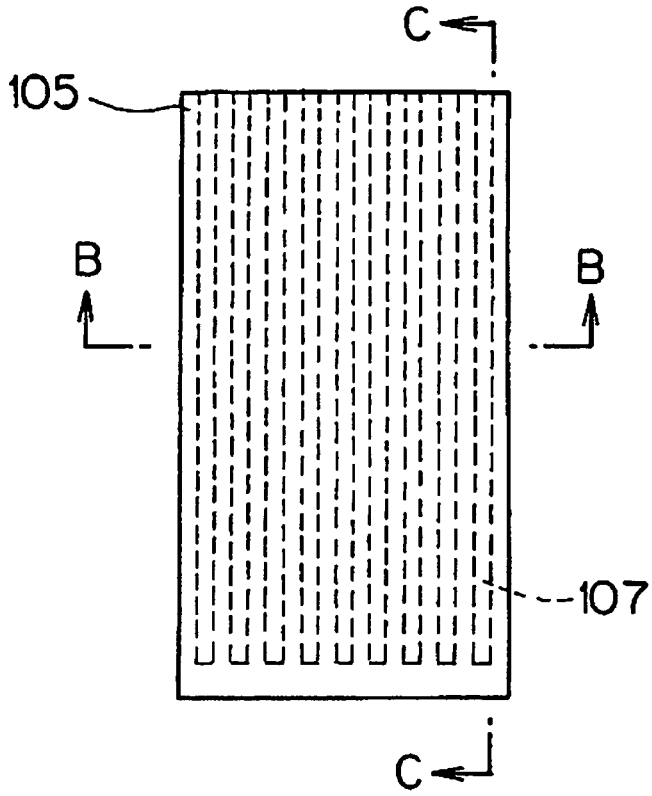
FIGS. 5(A) to 5(C) shows a conventional molding die for molding lubricant molded bodies, FIG. 5(A) being a plane view of the molding die, and FIG. 5(B) being a sectional view along a B-B line in FIG. 5(A), and FIG. 5(C) being a sectional view along a C-C line of FIG. 5(A).
Figure 5B:
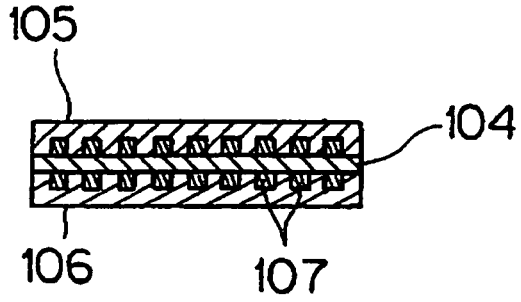
Figure 5C:
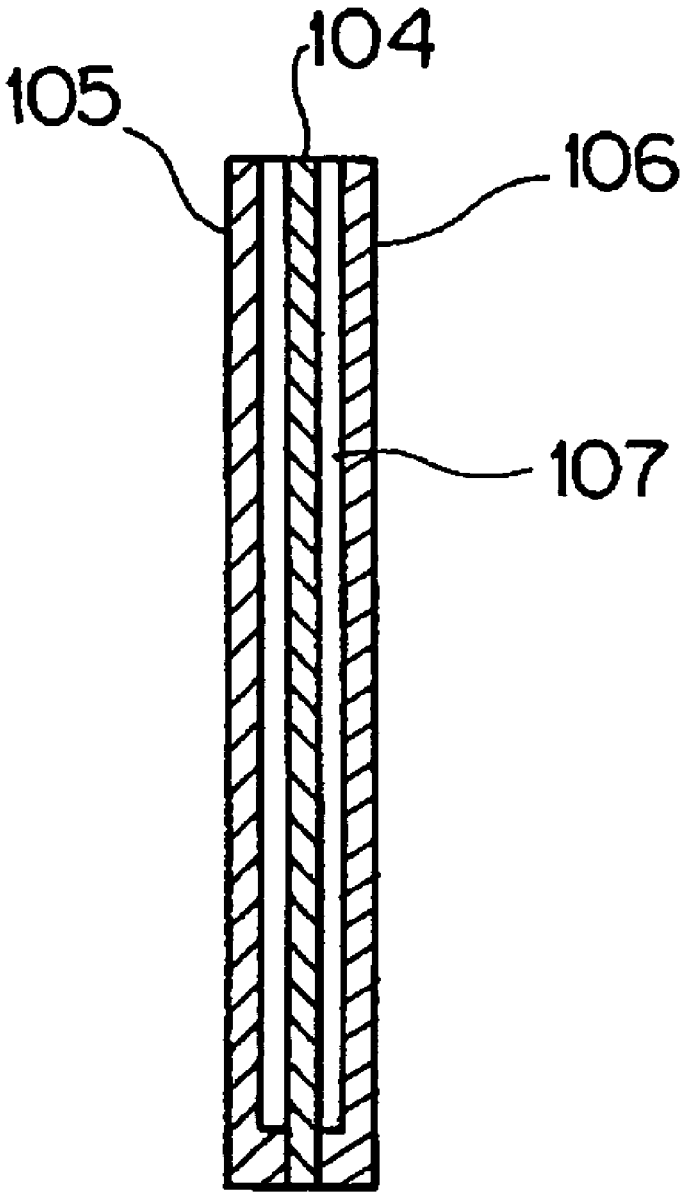

The above-mentioned lubricant molded body 3*a* is preferably manufactured by using a molding die that molds the conventional lubricant molded bodies shown in FIG. 5, but that molding die other than the above which molds the lubricant molded bodies can be used so long as it doesn't contradict the object of the present invention.

For example, the above-mentioned higher fatty acid metallic salt is at least one higher fatty acid metallic salt selected from the group consisting of zinc stearate, barium stearate, iron stearate, nickel stearate, cobalt stearate, copper stearate, strontium stearate, calcium stearate, magnesium stearate, zinc oleate, manganese oleate, iron oleate, cobalt oleate, magnesium oleate, zinc palmitate, manganese palmitate, iron palmitate, cobalt palmitate, and magnesium palmitate.

In the present invention, the above higher fatty acid metallic salts are preferably composed of at least two kinds of the above-mentioned higher fatty acid metallic salts with different carbon numbers, respectively. When the above higher fatty acid metallic salts comprise at least two kinds of the higher fatty acid metallic salts with the different numbers of carbons, respectively, fine crystallization is promoted based on the difference in crystallization temperature between at least two kinds of the higher fatty acid metallic salts. Consequently, the lubricant molded body 3*a* having far fewer cracking and cutting can be provided at a low cost irrespective of the manufacturing method Moreover, fine pieces of the foamed resin body may be mixed into the above-mentioned higher fatty acid metallic salts in the present invention. When the fine pieces of the foamed resin body are mixed into the above-mentioned higher fatty acid metallic salts, cracking and cutting can be reduced because they can absorb the strain generated when the higher fatty acid metallic salts are solidified through being cooled. The fine pieces of the foamed resin body are mixed into the lubricant molded body preferably at a rate of 1 to 10% of the entire weight of the lubricant molded body, which is taken as 100% by weight. If the mixing ratio of fine pieces of the above-mentioned foamed resin body is less than 1% by weight, the effect of absorbing the strain cannot be exhibited when the higher fatty acid metallic salts are solidified. On the other hand, if the mixing ratio of the fine pieces of the above-mentioned foamed resin body exceeds 10% by weight, excellent function of the lubricant is lost.

Moreover, the higher fatty acid metallic salts may be impregnated into the block of the foamed resin body in the present invention. In this way, when the higher fatty acid metallic salts are impregnated into the block of the foamed resin body, the foamed resin block absorbs the strain generated when the melted higher fatty acid metallic salts are solidified. Consequently, cracking and cutting of the lubricant molded body are decreased. In addition, the lubricant molded body can be manufactured merely by the impregnation of the melted higher fatty acid metallic salts into the block of the foamed resin body. The foamed resin block is preferably one of foamed resin blocks chosen from a sheet-shaped foamed resin block, a cylindrical foamed resin block and a step-shaped foamed resin block. The foamed resin block may be any foamed resin block having a shape other than those recited above, so long as it doesn't contradict the object of the present invention.

The above foamed resin body preferably has an open-cell structure. A time period required to impregnate the melted higher fatty acid metallic salts into the foamed resin body can be shortened when the foamed resin body has the open-cell structure. The cell diameters of the foamed resin body are preferably 10 μm to 500 μm. When the cell diameters of the above-mentioned foamed resin body are 10 μm to 500 μm like this, the yield can be maintained to 90% or more.

Figure 3:
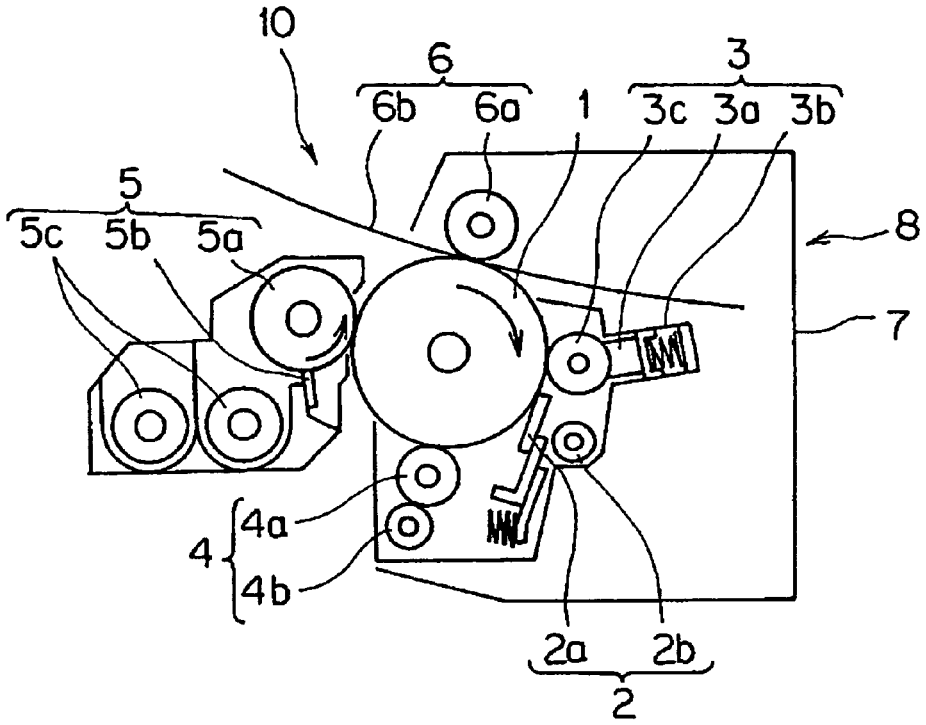
FIG. 3 is a schematic view of a first embodiment of the image forming apparatus according to the present invention.

As shown in FIG. 3, the lubricant application apparatus 3 of the present invention comprises a lubricant molded body 3*a*, and a brush roller 3*c*. The brush roller 3*c* contacts both the lubricant molded body 3*a* and an image carrier 1, and is adapted to form a film of the lubricant on a surface of a photosensitive layer of the image carrier 1 through scraping off the lubricant molded body and supplying the scraped lubricant on that surface. The lubricant molded body is one mentioned above. In FIG. 3, 3*b* is a compression member. In the lubricant application apparatus 3 comprising the lubricant molded body 3*a* and the brush roller 3*c* which contacts both the lubricant molded body 3*a* and the image carrier 1 and is adapted to form a film of the lubricant on the surface of the photosensitive layer of the image carrier 1 through scraping off the lubricant molded body and supplying the scraped lubricant on that surface, when the lubricant molded body according to the present invention is used as the lubricant molded body 3*a*, cracking and cutting of the lubricant molded body 3*a* can be reduced to prolong the use life of the lubricant application apparatus.

The applied quantity of the lubricant of the lubricant of the lubricant molded body 3*a* is controlled with brush roller 3*c*, and the lubricant is uniformly rubbed and smoothened with cleaning means 2 arranged in the direction of movement downstream side of image carrier 1, thereby enabling the supply of the lubricant in a constant amount for a long term. In particular, it is effective to use cleaning blade 2*a*, as cleaner 2, which easily and uniformly rubs and smoothens the lubricant from the standpoint of the construction. With respect to the rotation of the brush roller 3*c* and the image carrier 1, the former had better rotate in the same direction as that of the latter at the contact between them. Because the image carrier 1 and the brush roller 3*c* contact each other in the forward direction, the fine powder of the lubricant that peels off from the brush roller 3*c* flies to the downstream side in the rotating direction of the image carrier 1. The application efficiency of the lubricant is greatly increased as compared with the counter-direction contacting, and the solid lubricant can be miniaturized through prolonging the use life thereof.

As shown in FIG. 3, a process cartridge 8 of the present invention comprises an image carrier 1, a cartridge casing 7 rotatably holding the image carrier, and the above lubricant application apparatus 3 housed in the cartridge casing 7. When the process cartridge 8 of the present invention comprises the image carrier 1, the cartridge casing 7 rotatably holding the image carrier 1, and the above lubricant application apparatus 3 housed in the cartridge casing 7, cracking and cutting of the lubricant molded body 3*a* can be reduced to prolong the use life of the lubricant application apparatus 3. Because the exchanging work etc. of those parts becomes easy, the exchange time for the parts can be shortened.

The process cartridge 8 of the present invention has the above cleaner 2 and the lubricant application apparatus 3 on the upstream side of the cleaner 2 in the moving direction of the image carrier 1. In this way, when the process cartridge 8 has the cleaner 2 and the lubricant application apparatus 3 on the upstream side of the cleaner 2 in the moving direction of the image carrier 1, and an applied film of the lubricant is formed by applying the lubricant to the surface of the photosensitive layer of the image carrier 1 after a transfer step. Subsequently, a coating film of the lubricant can be formed by slide contacting the cleaner 2 on the surface of the applied lubricant film. Therefore, cleaning is uniformly effected, and charging hazard is realized. Consequently, the cleaning performance on the surface of the photosensitive layer is maintained for a longer time, and the image having a further high-resolution can be obtained.

Figure 2A:
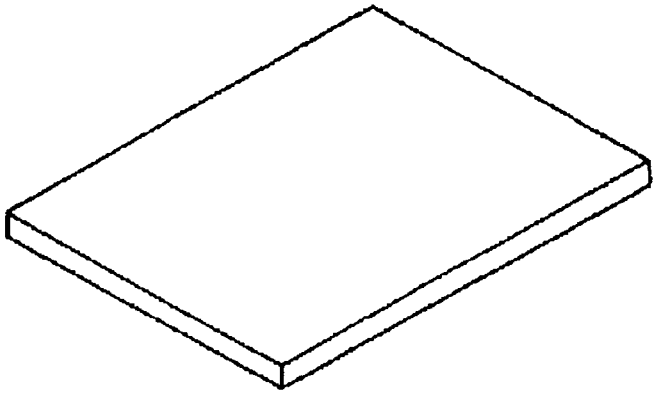
FIGS. 2(A) to 2(C) are schematic views of foamed resin blocks into which the higher fatty acid metallic salts of the lubricant molded body is to be impregnated in preferred embodiments of the present invention, FIG. 2(A) being a sheet-shaped foamed resin block, FIG. 2(B) being a cylindrical foamed resin block, and FIG. 2(C) being a step-shaped foamed resin block.
Figure 2B:
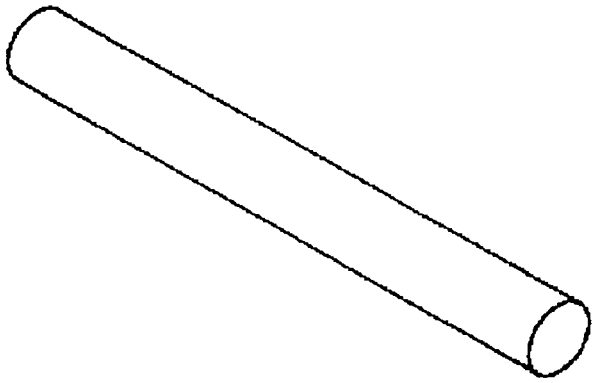

The cleaner 2 preferably has a cleaning blade 2*a* in process cartridge 8 of the present invention. In FIG. 2, 2*b* is a toner recovery coil. When the cleaner 2 has the cleaning blade 2*a* like this, the lubricant can be easily supplied in a constant amount for a long time with no addition of other parts to uniformly rub and smoothen.

The cleaning blade 2*a* is a planar elastic body made of a urethane elastomer, a silicone elastomer, and a fluorine elastomer. The cleaning blade 2*a* is provided such that its edge touches the surface of the photosensitive layer of the image carrier. Thereby, the toner and paper pieces remaining on the image carrier are removed after the transfer step. Especially, the urethane elastomer is excellent from the standpoint of the wear resistance and high machine strength, etc. Although not shown, the cleaning blade is bonded to and supported by a supporting member made of a metal, plastic, ceramics or the like, and is set at given angle relative to the image carrier 1. The cleaning blade 2*a* is pressed with a spring, and fixed to a casing of the cleaner 2, so that the cleaning blade is contacted with the surface of the photosensitive layer with a predetermined contact pressure at a given bite amount.

As shown in FIG. 3, the image forming apparatus 10 of the present invention comprises the above process cartridge 8, the charging device (charger) 4 for uniformly charging the surface of the photosensitive layer of the image carrier, the exposing device (not shown) to expose the surface of the photosensitive layer and to form the electrostatic latent image on the surface of the photosensitive layer, the developing device (developer) 5 to visualize the electrostatic latent image on the surface of the photosensitive layer by feeding the toner thereon, the transfer device (transfer unit) 6 to transfer the toner image on the surface of the photosensitive layer onto the transfer medium (not shown), and the cleaning device (cleaner) 2 to clean the surface of the photosensitive layer of the image carrier after the transfer step. In image forming apparatus 10 of the present invention, the charging means (charging device) 4 is preferably composed of charging roller 4*a*, and charging cleaning roller 4*b*. The development means (developer) 5 is preferably composed of a development sleeve 5*a*, a doctor blade 5*b* and screws 5*c*. A transfer means (transfer device) is preferably composed of a transfer roller 6*a* and an intermediate transfer belt 6*b*.

The image forming apparatus comprises at least the process cartridge 8, the charging means (charging device) 4 which uniformly charges the surface of the photosensitive layer of the image carrier 1, the exposure means (not shown) which forms the electrostatic latent image through exposing the surface of the photosensitive layer, the developing means (developer) 5 which visualizes the electrostatic latent image on the photosensitive layer by feeding the toner thereon, the transfer means (transfer device) 6 which transfers the toner image onto the transfer medium (not shown), and the cleaning means (cleaner) 2 which cleans the surface of the photosensitive layer after the transfer step. Thus, the images having high quality can be obtained over a long time period inexpensively.

EXAMPLE 1

Die portions 105 and 106 were assembled and fastened together via a middle die portion 104 as shown in FIG. 5 such that grooved faces of the die portions 105 and 106 contacted flat faces of the middle die portion 104, respectively. Each of the die portions 105 and 106 was made of a thick aluminum plate which had, at one face, nine grooves each having a width of 8 mm, a depth of 7 mm and a length of 380 mm. The thus assembled die was assembled and set to have totally eighteen channels, which could form totally eighteen blocks. A mixed solution was obtained by heating 99.9 wt % of zinc stearate and 0.1 wt % of silica (additive) up to 135° C., and was poured into the die heated to 150° C. with a heater, and then a heat insulating lid heated to 140° C. was placed on the die. After the die was kept at 150° C. for ten minutes, it was left in air to be cooled down to 105° C. Then, after the die was kept at 105° C. for fifteen minutes, it was left in air to be cooled down to 50° C. Further, after the die was kept at 50° C. for fifteen minutes, it was left in air to be cooled down to not more than 40° C. Thereafter, the die was opened to obtain lubricant molded bodies made of zinc stearate. Such lubricant molded bodies were obtained by repeating the same operations 20 times.

Cracks and cuts of the thus obtained lubricant molded bodies were visually inspected. Inspection of internal bubbles with a transmitted beam revealed that the yield of the lubricant molded body was 95%.

As shown in the following Table 1, although the shape of the cavities 7 was changed, the yields of the lubricant molded bodies were expected to rise over all the shapes tested. In Table 1, the yields (%) are given to respective kinds of the samples having varied shapes and dimensions. Moreover, "a", "b", and "l" in Table 1 are sizes of the lubricant molded body shown in FIG. 1.

TABLE 1

| | Shape dimensions | | | Yield (%) | |
|---|---|---|---|---|---|
| Sample No | a (mm) | b (mm) | l (mm) | No additive | Additive added |
| 1 | 3.0 | 6.0 | 300.0 | 88 | 99 |
| 2 | 3.0 | 10.0 | 300.0 | 80 | 98 |
| 3 | 3.0 | 12.0 | 350.0 | 80 | 98 |
| 4 | 6.0 | 8.0 | 400.0 | 84 | 96 |
| 5 | 8.0 | 7.0 | 380.0 | 82 | 95 |
| 6 | 8.0 | 8.0 | 390.0 | 82 | 94 |
| 7 | 10.0 | 10.0 | 400.0 | 73 | 89 |
| 8 | 11.5 | 16.0 | 400.0 | 65 | 75 |
| 9 | 15.0 | 20.0 | 400.0 | 49 | 61 |
| 10 | 20.0 | 20.0 | 400.0 | 39 | 48 |
| 11 | 25.0 | 25.0 | 400.0 | 17 | 20 |

EXAMPLE 2

Die portions 105 and 106 were assembled and fastened together via a middle die portion 104 as shown in FIG. 5 such that grooved faces of the die portions 105 and 106 contacted flat faces of the middle die portion 104, respectively. Each of the die portions 105 and 106 was made of a thick aluminum plate which had, at one face, nine grooves each having a width of 8 mm, a depth of 8 mm and a length of 390 mm. The die was assembled and set to have totally eighteen channels, which could form totally eighteen blocks. A mixed solution was obtained by heating 63 wt % of zinc stearate, 30 wt % of zinc palmitate, 3 wt % of zinc myristate, 2 wt % oleate, 1 wt % of zinc linoleate and 1 wt % of zinc arachidate up to 135° C. The resulting mixed solution was poured into the die heated to 150° C. with a heater, and then a heat insulating lid heated to 140° C. was placed on the die. After the die was kept at 160° C. for ten minutes, it was left in air be cooled down to 105° C. Then, after the die was kept at 105° C. for fifteen minutes, it was left in air to be cooled down to 50° C. Further, after the die was kept at 50° C. for fifteen minutes, it was left in air to be cooled down to not more than 40° C. Thereafter, the die was opened to obtain lubricant molded bodies made of zinc stearate, etc. Such lubricant molded bodies were obtained by repeating the same operations 20 times.

Cracks and cuts of the thus obtained lubricant molded bodies were usually inspected. Inspection of internal bubbles with a transmitted beam revealed that the yield of the lubricant molded body was 95%

Similarly, higher fatty acid metallic salts having different long chains shown in the following Table 2 were added, and the lubricant molded bodies were molded. Yields of them could be raised compared with the case having zinc stearate alone.

TABLE 2

| Sample No. | Wt % | | | | | | | |
|---|---|---|---|---|---|---|---|---|
| | Zinc stearate | Zinc laurate | Zinc myristate | Zinc palmitate | Zinc oleate | Zinc linoleate | Zinc arachiate | Yield (%) |
| 1 | 100 | 0 | 0 | 0 | 0 | 0 | 0 | 75 |
| 2 | 93.5 | 0.5 | 0 | 5 | 1 | 0 | 0 | 82 |
| 3 | 85.8 | 0.7 | 0 | 10 | 3 | 0 | 0.5 | 87 |
| 4 | 83 | 1 | 1 | 10 | 5 | 0 | 0 | 87 |
| 5 | 73.1 | 2 | 5 | 15 | 4.4 | 0.5 | 0 | 91 |
| 6 | 69.5 | 1 | 10 | 15 | 4 | 0.5 | 0 | 90 |
| 7 | 60.5 | 0 | 15 | 20 | 4 | 0.5 | 0 | 91 |
| 8 | 56.2 | 0 | 17 | 20 | 5.8 | 0 | 1 | 91 |
| 9 | 29.9 | 0.5 | 14.1 | 50 | 4 | 1.5 | 0 | 90 |
| 10 | 55 | 0 | 0 | 40 | 0 | 3 | 2 | 91 |
| 11 | 51.4 | 0 | 12.6 | 35 | 0 | 0 | 1 | 91 |
| 12 | 53 | 0 | 0 | 25 | 16 | 4 | 2 | 91 |
| 13 | 60 | 4 | 2 | 25 | 4 | 2 | 3 | 94 |
| 14 | 61 | 2 | 3 | 30 | 2 | 1 | 1 | 95 |

EXAMPLE 3

Die portions 105 and 106 are assembled and fastened together via middle die portion 104 as shown in FIG. 5 such that grooved faces of the die portions 105 and 106 contacted flat faces of the middle die portion 104, repectively. Each of the die portions 105 and 106 was made of a thick aluminum plate which had, at one face, nine grooves each having a width of 11.5 mm, a depth of 16 mm and a length of 400 mm. The thus assembled die had totally eighteen channels, which could form totally eighteen blocks. a mixed solution was obtained by heating 99.5 wt % of zinc stearate and 0.5 wt % of magnesium stearate up to 140° C., and was poured into the die set and heated to 130° C. to 200° C. with a heater, and then a heat insulating lid heated to 140° C. was placed on the die. After the die was kept at 150° C. for ten minutes, it was left in air to be cooled down to not more than 40° C. Thereafter, the die was opened to obtain lubricant molded bodies made of zinc stearate. Such lubricant molded bodies were obtained by repeating the same operations 20 times.

Cracks and cuts of the thus obtained lubricant molded bodies were visually inspected. Inspection of internal bubbles with a transmitted beam revealed that the yield of the lubricant molded body was 98%.

Similarly, molding materials composed of various higher fatty acid metallic salts that had calcium, aluminum, lead, cobalt, nickel, iron, copper tin, lithium or sodium added as other metal element were molded. Yeilds of the lubricant molded bodies are as shown in the following Table 3, which yields were enhanced as compared with the case of zinc stearate alone.

TABLE 3

| Sample No. | Zn | Ca | Mg | Al | Pb | Co | Ni | Fe | Cu | Mn | Sn | Li | Na | Yield (%) |
|---|---|---|---|---|---|---|---|---|---|---|---|---|---|---|
| 1 | 100.0 | 0.0 | 0.0 | 0.0 | 0.0 | 0.0 | 0.0 | 0.0 | 0.0 | 0.0 | 0.0 | 0.0 | 0.0 | 75 |
| 2 | 99.5 | 0.5 | 0.0 | 0.0 | 0.0 | 0.0 | 0.0 | 0.0 | 0.0 | 0.0 | 0.0 | 0.0 | 0.0 | 82 |
| 3 | 99.0 | 1.0 | 0.0 | 0.0 | 0.0 | 0.0 | 0.0 | 0.0 | 0.0 | 0.0 | 0.0 | 0.0 | 0.0 | 86 |
| 4 | 98.5 | 1.5 | 0.0 | 0.0 | 0.0 | 0.0 | 0.0 | 0.0 | 0.0 | 0.0 | 0.0 | 0.0 | 0.0 | 88 |
| 5 | 99.5 | 0.0 | 0.5 | 0.0 | 0.0 | 0.0 | 0.0 | 0.0 | 0.0 | 0.0 | 0.0 | 0.0 | 0.0 | 94 |
| 6 | 99.0 | 0.0 | 1.0 | 0.0 | 0.0 | 0.0 | 0.0 | 0.0 | 0.0 | 0.0 | 0.0 | 0.0 | 0.0 | 98 |
| 7 | 98.5 | 0.0 | 1.5 | 0.0 | 0.0 | 0.0 | 0.0 | 0.0 | 0.0 | 0.0 | 0.0 | 0.0 | 0.0 | 96 |
| 8 | 99.0 | 0.0 | 0.0 | 1.0 | 0.0 | 0.0 | 0.0 | 0.0 | 0.0 | 0.0 | 0.0 | 0.0 | 0.0 | 80 |
| 9 | 99.0 | 0.0 | 0.0 | 0.0 | 1.0 | 0.0 | 0.0 | 0.0 | 0.0 | 0.0 | 0.0 | 0.0 | 0.0 | 82 |
| 10 | 99.0 | 0.0 | 0.0 | 0.0 | 0.0 | 1.0 | 0.0 | 0.0 | 0.0 | 0.0 | 0.0 | 0.0 | 0.0 | 81 |
| 11 | 99.0 | 0.0 | 0.0 | 0.0 | 0.0 | 0.0 | 1.0 | 0.0 | 0.0 | 0.0 | 0.0 | 0.0 | 0.0 | 83 |
| 12 | 99.0 | 0.0 | 0.0 | 0.0 | 0.0 | 0.0 | 0.0 | 1.0 | 0.0 | 0.0 | 0.0 | 0.0 | 0.0 | 77 |
| 13 | 99.0 | 0.0 | 0.0 | 0.0 | 0.0 | 0.0 | 0.0 | 0.0 | 1.0 | 0.0 | 0.0 | 0.0 | 0.0 | 80 |
| 14 | 99.0 | 0.0 | 0.0 | 0.0 | 0.0 | 0.0 | 0.0 | 0.0 | 0.0 | 1.0 | 0.0 | 0.0 | 0.0 | 82 |
| 15 | 99.0 | 0.0 | 0.0 | 0.0 | 0.0 | 0.0 | 0.0 | 0.0 | 0.0 | 0.0 | 1.0 | 0.0 | 0.0 | 77 |
| 16 | 99.0 | 0.0 | 0.0 | 0.0 | 0.0 | 0.0 | 0.0 | 0.0 | 0.0 | 0.0 | 0.0 | 1.0 | 0.0 | 79 |
| 17 | 95.0 | 0.0 | 0.0 | 0.0 | 0.0 | 0.0 | 0.0 | 0.0 | 0.0 | 0.0 | 0.0 | 0.0 | 5.0 | 86 |

EXAMPLE 4

Figure 4:
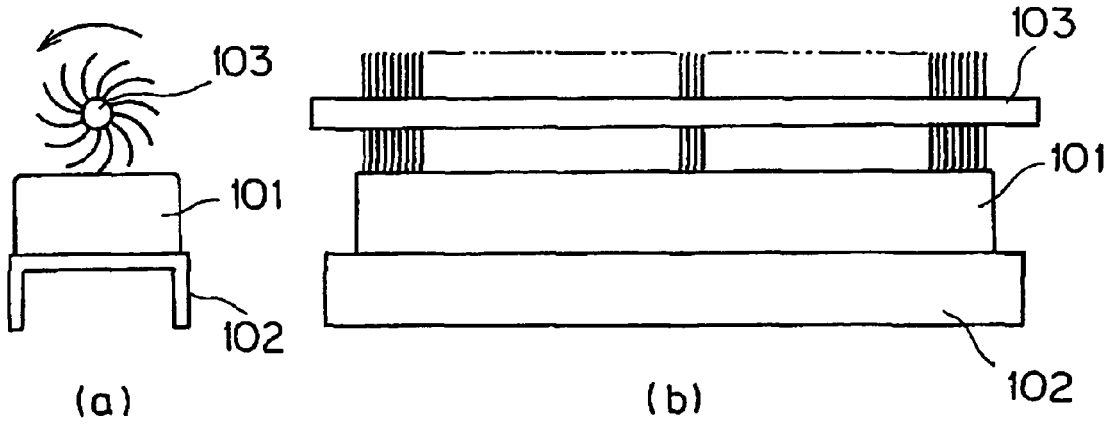
FIG. 4 is a schematic view of a conventional lubricant application apparatus.

Die portions 105 and 106 were assembled and fastened together a middle die portion 104 as shown in FIG. 5 such that grooved faces of the die portions 105 and 106 contacted flat faces of the middle die portion 104, respectively. Each of die portions 105 and 106 was made of a thick aluminum plate which had, at one face, nine grooves each having a width of 11.5 mm, a depth of 16 mm and a length of 400 mm. The die was assembled and set to have totally eighteen channels, which could form totally eighteen blocks. A melt was obtained by heating zinc stearate up to 140° C. and fine pieces of a foamed resin were mixed into the melt. SM55 (made by INOAC Corporation), BASOTECT (made by BASF Corporation), and everlight (made by Bridgestone Co., Ltd), etc. are available as such foamed resin fine pieces. As shown in the following FIG. 4, the filling completion time period and the yield are influenced depending on foaming (single foaming, continuous foaming) and diameters of cells.

TABLE 4

| Cell diameter (μm) | 0.1 | 1 | 5 | 10 | 30 | 50 | 100 | 300 | 500 | 1000 |
|---|---|---|---|---|---|---|---|---|---|---|
| Filling time (single foaming) (mIN.) | — | — | — | — | — | 103 | 53 | 20 | 13 | 8 |
| Filling time (continuous foaming) (min.) | 50 | 8 | 4 | 3 | 3 | 3 | 3 | 3 | 3 | 3 |
| Yield (%) | 98 | 98 | 97 | 97 | 97 | 97 | 96 | 94 | 92 | 88 |

However, since there is no difference in quality, etc. among manufactures, any one of them may be used. In the present invention, BASOTECT having the average cell diameter of 50 μm. A horizontal line section appearing in Table 4 shows that a complete lubricant molded body was not obtained. The mixture of the pieces of the foamed resin body and the solution of zinc stearate was poured into the metal mold heated to 130-200° C. by a heater, and the mold was covered with a heat-insulating lid plate heated to 140° C. Next, after keeping the metal die 150° C. for ten minutes, it was left in air to cool the entire die down to not more than 40° C. Thereafter, the die was opened, thereby obtaining the lubricant molded bodies of zinc stearate. Same operations were repeated 20 times, thereby obtaining lubricant molded bodies.

Cracks and cuts of the thus obtained lubricant molded bodies were visually inspected. Inspection of internal bubbles with a transmitted beam revealed that the yield of the lubricant molded body was 97%.

EXAMPLE 5

Die portions 105 and 106 were assembled and fastened together a middle die portion 104 as shown in FIG. 5 such that grooved faces of the die portions 105 and 106 contacted flat faces of the middle die portion 104, respectively. Each of die portions 105 and 106 was made of a thick aluminum plate which had, at one face, nine grooves each having a width of 11.5 mm, a depth of 16 mm and a length of 400 mm. The die was assembled and set to have totally eighteen channels, which could form totally eighteen blocks. A melt was obtained by heating zinc stearate up to 140° C., and fine pieces of a foamed resin (Everlight, Bridgestone Co., Ltd.) were mixed into the melt. Then, the melt was impregnated into the fine pieces, followed by gradual cooling. Same operations were repeated 20 times. Then, it was revealed that the molded products added with 1 to 10 wt % of the foamed resin fine pieces exhibited higher yields than that of a case added with no foamed resin fine pieces.

TABLE 5

| Fine pieces of foamed resin body (wt %) | 0 | 1 | 3 | 5 | 7 | 9 | 10 | 15 | 20 |
|---|---|---|---|---|---|---|---|---|---|
| Yield (%) | 77 | 97 | 92 | 91 | 83 | 80 | 80 | 77 | 75 |

EXAMPLE 6

Figure 2C:
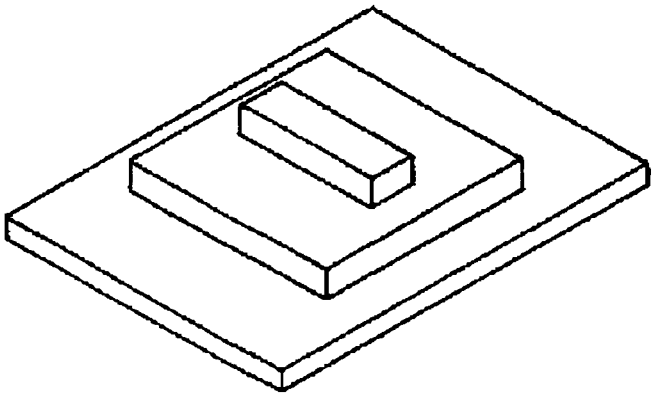

Zinc stearate, 10.0 kg, was charged into a heating pot heated up to 140° C., and melted there under heating. To the heating pot filled with the melted zinc stearate was sunk a block of an open-cell foamed resin body cut in a shape of 25×25×400 mm (BASOTECT made by BASF Corporation). After it has been left there for one minute, it was pulled up. Same operations were done with respect to 100 sponges having the same shape. Then, cracks and cuts of the thus obtained lubricant molded bodies were visually inspected. Inspection of internal bubbles with a transmitted beam revealed that the yield of the lubricant molded body was 90%. Same operations were effected with respect to a sheet-shaped block of a foamed resin body of 250×160×7 mm, a cylindrical block of a foamed resin body of 25 mm in diameter and 400 mm in length, and a stepwise block of a foamed resin body as shown in FIGS. 2(A), 2(B) and 2(C) used, respectively. Then, cracks and cuts of the thus obtained lubricant molded bodies were visually inspected. Inspection of internal bubbles with a transmitted beam revealed that the yield of the lubricant molded body was 70 to 98%. The shapes of those lubricant shaped bodies had excellent deviations within 0.5% of their respective original shapes.

An image formation apparatus equipped with each of the lubricant molded bodies obtained in Examples 1-6 and the lubricant molded bodies obtained in Comparative Example 1(usual product) was actually used. A process controller unit (PCU) that comprised the image carrier, the charging roller, the cleaning blade, the charging roller cleaner, the higher fatty acid metallic salt molded body and the application brush was evaluated every 1000 sheets in actual operation. Evaluation of the PCU was effected by observing the state of filming formed on the image carrier. The time when the filming appeared for 15% of the photosensitive body on the surface of the image carrier was judged to be the end of a use life. Occurrence of any defect of an image is represented by the total number of images, as index, when a line or lines appear on the last image due to insufficient cleaning.

Evaluation results are given in the following Table 6.

TABLE 6

| Kind of higher fatty acid metallic salts | Example 1 | Example 2 | Example 3 | Example 4 | Example 5 | Example 6 | Comparative Example 7 |
|---|---|---|---|---|---|---|---|
| Use life (×1000 sheets) | 60 | 74 | 80 | 76 | 74 | 72 | 55 |

TABLE 6-continued

| Kind of higher fatty acid metallic salts | Example 1 | Example 2 | Example 3 | Example 4 | Example 5 | Example 6 | Comparative Example 7 |
|---|---|---|---|---|---|---|---|
| Number of sheet when disorder occurred (×1000) | 78 | 90 | 91 | 87 | 84 | 82 | 69 |

From Table 6, it is seen that the lubricant molded bodies obtained in Examples 1-6 exhibited longer usable spans as compared with that of the lubricant molded body (ordinary quality product) obtained by Comparative Example 1.

What is claimed is:

1. A lubricant molded body comprising at least two kinds of higher fatty acid metallic salts having respectively different carbon numbers, wherein fine pieces of a foamed resin are mixed with the higher fatty acid metallic salts, wherein the fine pieces of the foamed resin are present in the lubricant molded body in an amount of 1 to 10% by weight, and wherein the at least two kinds of higher fatty acid metallic salts are impregnated into a block of a foamed resin body having a plurality of vacancies within, the at least two kinds of higher fatty acid metallic salts filling the vacancies within the foamed resin body.

2. The lubricant molded body set forth in claim 1, wherein the higher fatty acid metallic salts contain at least one kind of fillers selected from the group consisting of silica, alumina, tungsten disulfide, molybdenum disulfide, graphite fluoride, graphite, boron nitride, polytetrafluoroethylene (PTFE), ethylene tetrafluoroethylene (ETFE), and polyvinylidene fluoride (PVDF).

3. The lubricant molded body set forth in claim 1, wherein the higher fatty acid metallic salts comprise at least two kinds of higher fatty acid metallic salts having respectively different metals.

4. The lubricant molded body set forth in claim 1, wherein the block of the foamed resin body is one kind of block selected from the group consisting of a sheet-shaped block of the foamed resin, a cylindrical block of the foamed resin, and a step-like block of the foamed resin.

5. The lubricant molded body set forth in claim 1, wherein the foamed resin body has an open-cell structure.

6. The lubricant molded body set forth in claim 5, wherein cell diameters of the foamed resin body are 10 μm to 500 μm.

7. A lubricant application apparatus comprising a lubricant molded body, and a brush roller which is to contact with both the lubricant molded body and an image carrier and to form a film of a lubricant onto a surface of a photosensitive layer of the image carrier by shaving off the lubricant molded body and supplying the shaved lubricant onto the surface of the photosensitive layer, said lubricant molded body being the lubricant molded body set forth in claim 1.

8. A process cartridge comprising an image carrier, a cartridge casing for retaining the image carrier in a freely rotatable manner, and the lubricant application apparatus set forth in claim 7.

9. The process cartridge set forth in claim 8, which further comprises a cleaning device and wherein the lubricant application apparatus is provided on an upstream side from the cleaning device in a moving direction of the image carrier.

10. The process cartridge set forth in claim 9, wherein the cleaning device has a cleaning blade.

11. An image forming apparatus comprising the process cartridge set forth in claim 8, a charging device for uniformly charging a surface of the photosensitive layer of the image carrier, an exposing device to expose a surface of the photosensitive layer and to form an electrostatic latent image on the surface of the photosensitive layer, a developing device to visualize the electrostatic latent image on the surface of the photosensitive layer by feeding a toner thereon, a transfer device to transfer the toner image on the surface of the photosensitive layer onto a transfer medium, and a cleaning device to clean the surface of the photosensitive layer of the image carrier after the transfer.

12. The image forming apparatus set forth in claim 11, wherein the lubricant application apparatus in claim 10 is arranged in a downstream side of the image carrier and on an upper stream side of the cleaning device as viewed from the transcript device.

13. The image forming apparatus set forth in claim 11, wherein the cleaning device has a cleaning blade.

14. The lubricant molded body set forth in claim 1, wherein the fine pieces of the foamed resin are mixed into the lubricant molded body in an amount of 1 to 5% by weight.

15. A lubricant molded body, comprising:

at least two kinds of fatty acid metallic salts, each of the fatty acid metallic salts having a different number of carbon atoms; and fine pieces of a foamed resin, the foamed resin being distinct from the fatty acid metallic salts in that the foamed resin is not formed of a material including the fatty acid metallic salts, the fine pieces of the foamed resin being mixed with the fatty acid metallic salts in an amount of 1 to 10% by weight relative to a total weight of the lubricant molded body.

* * * * *